US005358387A

United States Patent [19]

Suzuki et al.

[11] Patent Number: 5,358,387

[45] Date of Patent: Oct. 25, 1994

[54] OIL-FREE SCROLL COMPRESSOR

[75] Inventors: Akira Suzuki, Tokyo; Masakazu Aoki, Shimizu, both of Japan

[73] Assignee: Hitachi Ltd., Tokyo, Japan

[21] Appl. No.: 197,466

[22] Filed: Feb. 16, 1994

Related U.S. Application Data

[63] Continuation of Ser. No. 890,246, May 29, 1992, abandoned.

[30] Foreign Application Priority Data

May 29, 1991 [JP] Japan ..... 3-126154

[51] Int. Cl.[5] ..... F04B 35/04; F04B 41/06; F04B 49/02; F04C 18/04

[52] U.S. Cl. ..... 417/295; 417/362; 417/410.5; 418/55.1; 418/60; 418/83

[58] Field of Search ..... 418/5, 55.1, 58, 60, 418/83, 210; 417/295, 362, 410 D

[56] References Cited

U.S. PATENT DOCUMENTS

| | | | |
|---|---|---|---|
| 3,367,562 | 2/1968 | Persson et al. | 417/295 |
| 3,994,633 | 11/1976 | Shaffer | 418/5 |
| 4,192,152 | 3/1980 | Armstrong et al. | 418/5 |
| 4,515,539 | 5/1985 | Morishita | 418/55.1 |
| 4,529,363 | 7/1985 | Suzuki | 417/295 |
| 4,611,975 | 9/1986 | Blain | 418/5 |
| 4,741,674 | 5/1988 | Tischer | 417/295 |

FOREIGN PATENT DOCUMENTS

| | | | |
|---|---|---|---|
| 3814931 | 11/1988 | Fed. Rep. of Germany | 418/60 |
| 57-38690 | 3/1982 | Japan | 418/60 |
| 61-215479 | 9/1986 | Japan | 418/55.1 |
| 63-179185 | 7/1988 | Japan . | |
| 2-67494 | 3/1990 | Japan | 418/58 |
| 2-264177 | 10/1990 | Japan | 418/55.1 |

*Primary Examiner*—John J. Vrablik

*Attorney, Agent, or Firm*—Antonelli, Terry, Stout & Kraus

[57] ABSTRACT

An oil-free scroll compressor comprising a plurality of oil-free scroll compressing mechanism blocks, each for compressing a gas, and a motor or motors for driving the plurality of oil-free scroll compressing mechanism blocks. In operation, an air is suctioned into the compressor through a filter and a throttle valve and then divided and sucked into first and second oil-free scroll compressing mechanism blocks, which act to increase the pressure of the air to a predetermined pressure. The compressed air is cooled by an after-cooler and supplied to the compressed air user side. The scroll compressing mechanism blocks are driven by a dual-shaft motor through belts. Under no-load condition, the throttle valve is closed and a release valve is opened, whereby the compressed air held between the blocks and check valves is released.

3 Claims, 3 Drawing Sheets

OIL-FREE SCROLL COMPRESSOR

This application is a continuation of application Ser. No. 07/890,246, filed May 29, 1992, abandoned.

BACKGROUND OF THE INVENTION

1. Field of the Invention

The present invention relates to an oil-free scroll compressor and, more particularly, it relates to an oil-free scroll compressor including a plurality of scroll compressing mechanism blocks, with an object of increasing an overall of the oil-free scroll compressor.

2. Description of the Prior Art

The oil-free scroll compressor has been used to supply an oil-free compressed gas, typically, an oil-free compressed air. In one type of the oil-free scroll compressor, the scroll compressing mechanism block for compressing a gas comprises a fixed scroll and an orbiting scroll, each having an end plate and a spiral wrap upstanding from the end plate, with the scrolls being assembled together so that their axes are in staggered relation from each other and their wraps are in meshing relation with each other. A motor is provided to produce an orbiting motion of said orbiting scroll relatively to the fixed scroll, without producing a rotation of the orbiting scroll about its own axis, whereby a gas is compressed in a compressing space formed between the orbiting scroll and the fixed scroll and the compressed gas is discharged to outside through a central discharge port formed in the end plate of the fixed scroll. Such construction of the scroll compressing mechanism block itself is substantially the same as that of a conventional oil-lubricated type scroll compressor. An example of the oil-free scroll compressing mechanism block of this type is disclosed in Japanese Patent Application Laid-Open No. Sho 63-179185.

In another type of the oil-free scroll compressor, the scroll compressing mechanism block for compressing a gas comprises two rotating scrolls, each having an end plate and a spiral wrap upstanding from the end plate, with the scrolls being assembled together so that their axes are in staggered relation from each other and their wraps are in meshing relation with each other. A motor or motors are provided to rotate the scrolls in a same direction and at a same speed, whereby a gas is compressed in a compressing space formed between the scrolls and discharged to outside through a central discharge port formed in the end plate of one of the scrolls. The construction of the scroll compressing mechanism block is substantially same as that of the conventional oil-lubricated scroll compressor of this type. An example of the oil-free scroll compressing mechanism block of this type is disclosed in Japanese Patent Application Laid-Open No. Hei 2-245486.

In the oil-free scroll compressor, no lubricant oil is supplied to the compressing space formed between the scrolls and, therefore, small clearances are held between the wraps of these scrolls and between the top of the wrap of one of the scrolls and the bottom surface opposed thereto of the other scroll. Otherwise, coating layers having self-lubricating property, such as coating layers of ethylene tetrafluoride resin, molybdenum disulfide or the like, are formed on the portions of the scroll which may come into contact with other parts during operation. Such coating layers are also formed on the sliding portions of the end plates of both scrolls.

The present invention is not directed to the construction of the oil-free scroll compressing block itself; however, to facilitate an understanding of the present invention, an explanation will be given to the construction of the oil-free scroll compressing block before describing the present invention.

Referring to FIG. 1, the oil-free scroll compressing mechanism block of the type disclosed in, for example, Japanese Patent Application Laid-Open No. Hei 2-245486, comprises a first scroll 1 having an end plate 1*a* and a spiral wrap 1*b* upstanding from said end plate, said end plate la including a pulley portion 1*c* integrally formed therewith. The oil-free scroll compressing mechanism block further comprises a second scroll 2 having an end plate 2*a* and a spiral wrap 2*b* upstanding from said end plate, said end plate 2*a* including a pulley portion 2*c* integrally formed therewith. A pulley 3 and a pulley 4 are fixedly mounted on a driving shaft 5, and the pulley 3 and the pulley portion 1*c* of the first scroll 1 are connected together by means of a timing belt 6 engaged therearound, while the pulley 4 and the pulley portion 2*c* of said second scroll 2 are connected together by means of a timing belt 7 engaged therearound. A chamber for housing the above elements is formed by frames 8, 9 and 10 which are connected together. The frames 8 and 9 are formed with bosses 8*a* and 9*a* respectively which project inwardly of said chamber. The first scroll 1 and the second scroll 2 are rotatably supported by said bosses 8*a* and 9*a* through radial bearings 11 and 12, respectively, and the wraps of the scrolls 1 and 2 are held in meshing relation with each other.

The axis of the boss 8*a* that is the axis of the first scroll 1, is arranged in staggered relation to the axis of the boss 9*a* that is the axis of the second scroll 2, with a distance therebetween which corresponds to a predetermined radius of rotation, so that a compressing space is formed between the wraps of both scrolls.

A thrust bearing 13 is arranged between the frame 8 and the end surface of the first scroll 1. A thrust bearing 14 and an elastic member 15 are arranged between the frame 9 and the end surface of the second scroll 2.

An air suction pipe 16 is connected to an inside cavity 8*b* of the boss 8*a*. Communicating passages 1*d* are formed in the end plate 1*a* of the first scroll 1 to communicate the inside cavity 8*b* of the boss 8*a* with a compressing space formed between the peripheral portions of the scrolls. A discharge port 2*d* formed at the center of the end plate 2*a* of the second scroll 2 communicates with an inside cavity 9*b* of the boss 9*a* and the inside cavity 9*b* is connected with an air discharge pipe 17. The above mentioned driving shaft 5 is supported by the frame 10 through bearings.

The shaft 5 is driven by a motor (not shown) and the rotation of the shaft 5 is transmitted through the pulleys 3 and 4, the timing belts 6 and 7 and the pulley portions 1*c* and 2*c* to the first scroll 1 and the second scroll 2, thereby producing the synchronized rotation of these scrolls in the same direction and at the same speed. Thus, air is conducted from the suction pipe 16 through the inside cavity 8*b* of the boss 8*a* and the communicating passages 1*d* to the compressing space formed between the scrolls 1 and 2. The air compressed in the compressing space is passed through the central discharge port 2*d* of the second scroll 2 and the inside cavity 9*b* of the boss 9*a* and discharged from the discharge pipe 17.

The conventional oil-free scroll compressor comprises a single scroll compressing mechanism block as described above and a single motor for driving said scroll compressing mechanism block. Generally speaking, in the construction of a scroll compressor, as the diameter of the scroll is increased, for example to a size larger than 300 mm $\phi$, a gas pressure applied to the end plate of the scroll is increased to an excessively high value and a vibration of the scroll caused by an imbalance of weight of the scroll is also increased to an excessively high value, so that it is technically difficult to manufacture a scroll compressor having a large diameter. Under these circumstances, the oil-free scroll air compressor which is currently manufactured is limited to a small compressor having a capacity lower than 3.7 KW.

On the other hand, a screw type compressor has been used as an oil-free rotary compressor. However, the screw type compressor is rather suitable for use as a compressor having a capacity higher than intermediate capacity, and it is actually difficult to produce an oil-free screw compressor having a capacity lower than 15 KW because it has a lowered performance and an increased temperature of discharged air.

OBJECT OF THE INVENTION

It is an object of the present invention to provide an oil-free scroll compressor which makes the best use of the advantages of a scroll compressor, that is, a high performance and a low noise, and which can provide an intermediate capacity of the order of 5.5–11 KW, between that of the conventional oil-free scroll compressor and that of the conventional oil-free screw compressor.

SUMMARY OF THE INVENTION

In accordance with the present invention there is provided an oil-free scroll compressor including a plurality of oil-free scroll compressing mechanism blocks for compressing a gas and at least one motor for driving said plurality of oil-free scroll compressing mechanism blocks.

In one embodiment of the present invention, the plurality of oil-free scroll compressing mechanism blocks have a same diameter.

In another embodiment of the present invention, the plurality of oil-free scroll compressing mechanism blocks have different diameters from each other.

In a further embodiment of the present invention there is provided an oil-free scroll compressor of the above kind in which use is made of one motor for driving said plurality of oil-free scroll compressing mechanism blocks.

In a yet further embodiment of the invention, there is provided an oil-free scroll compressor of the above kind, in which the plurality of oil-free scroll compressing mechanism blocks are connected in parallel.

In a still further embodiment of the present invention there is provided an oil-free scroll compressor of the above kind, in which the plurality of oil-free scroll compressing mechanism blocks are connected to form a multi-stage construction.

The oil-free scroll compressor according to the present invention is constituted of a plurality of oil-free scroll compressing mechanism blocks, so that the entire capacity of the compressor can be increased, while each of the scroll compressing mechanism blocks can be formed as a compact block having a relatively small diameter and providing high performance and a low noise. Accordingly, it is possible to produce an oil-free scroll compressor having an intermediate capacity of the order of 5.5–11 KW, which has so far been hardly manufactured from technical viewpoint. Each of the oil-free scroll compressing mechanism blocks can be formed as having a relatively small diameter, so that a thrust load applied on the surface of the end plate of the scroll owing to gas pressure is relatively low and, consequently, wearing of the scroll itself is decreased. Thus, the scroll can be driven without lubrication. The scroll compressing mechanism block having small diameter can be used, so that the load per one scroll compressing mechanism block is considerably decreased, with the result that the temperature of the discharged gas is lowered and the thermal expansion of the scroll itself is decreased so that the contact of the scrolls can be avoided. The temperature of the discharged air is lowered, so that it is possible to use a light-weight material, such as aluminum, as a scroll material, and, therefore, vibration caused by imbalance of weight of the scroll can be avoided and, furthermore, a corrosion resistance effect can be obtained, so that it is possible to manufacture an oil-free scroll compressor having high reliability.

DESCRIPTION OF THE PREFERRED EMBODIMENT OF THE INVENTION

Figure 1:
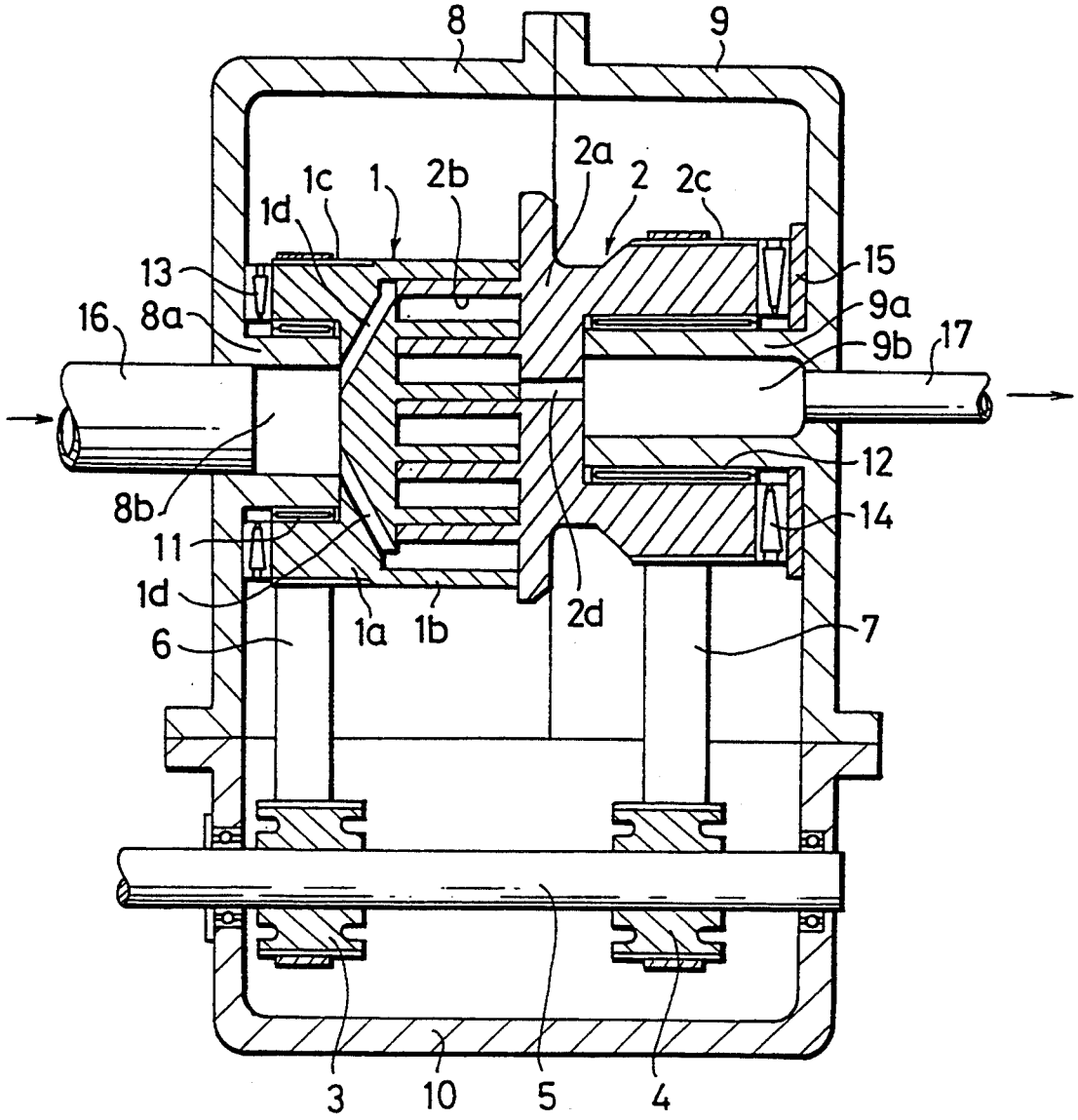
FIG.1 PRIOR ART
FIG. 1 illustrates an example of an oil-free scroll compressing mechanism block according to a prior art.
Figure 2:
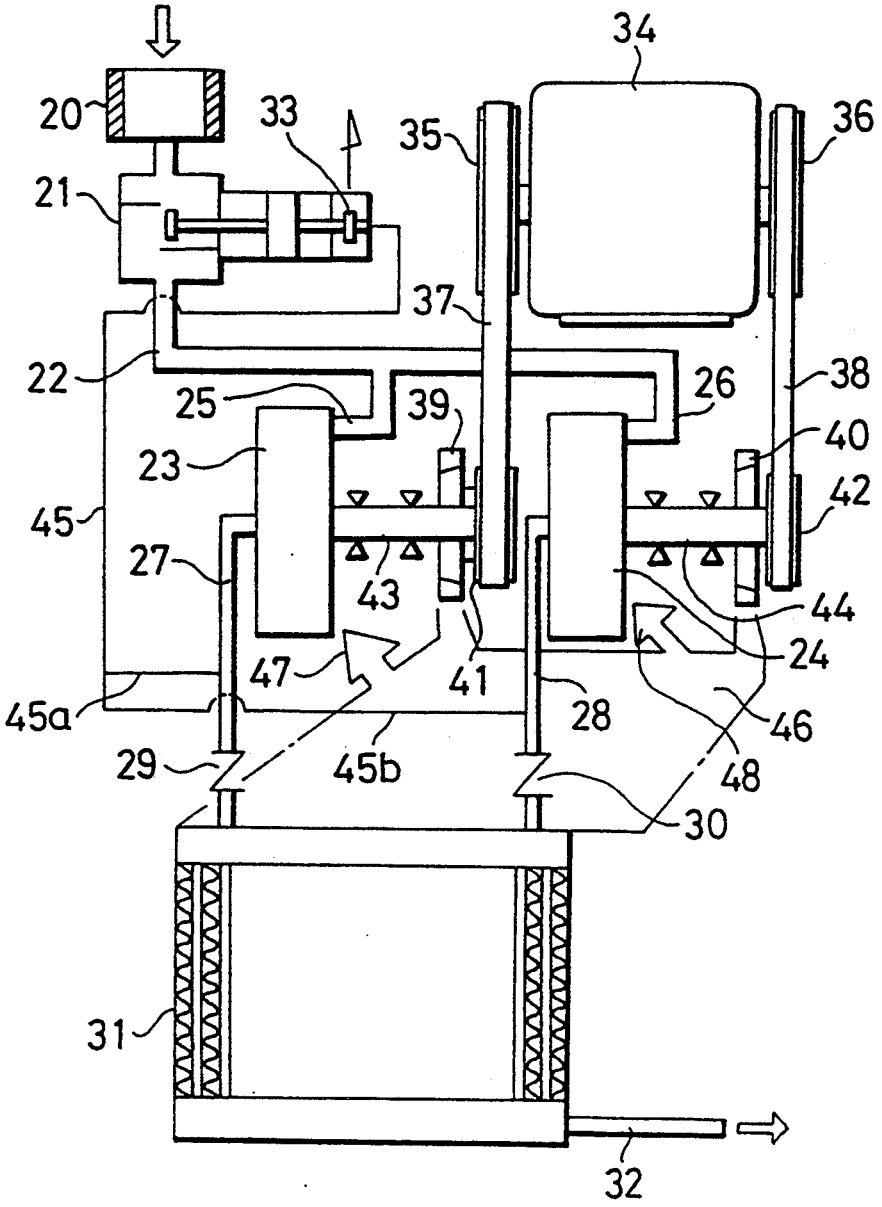
FIG. 2 illustrates an embodiment of the oil-free scroll compressor according to the present invention.

The oil-free scroll compressor according to the embodiment of the present invention, as shown in FIG. 2, includes a suction filter 20 for filtering an outside air to be suctioned into the scroll compressor, a throttle valve 21 arranged to be open at the time of loading of the oil-free compressor and to be closed at the time of no-loading of the compressor, a collecting pipe 22, first and second oil-free scroll compressing mechanism blocks 23 and 24 which are arranged to suction air from the collecting pipe 22 through suction pipes 25 and 26, to compress the air and to discharge the compressed air through discharging pipes 27 and 28, respectively, check valves 29 and 30 provided in the discharging pipes 27 and 28 of the scroll compressing mechanisms, respectively, an after-cooler 31 for cooling the compressed air discharged from the scroll compressing mechanism blocks 23 and 24, a compressed air discharging port 32, an air release valve 33 which is arranged to operate in association with the throttle valve 21 so that it is closed to atmosphere at the time of no-loading, a dual-shaft motor 34 for driving the compressing mechanism blocks 23 and 24, M-groove sheaves 35 and 36 fixed to both shafts of said motor, V-belts 37 and 38, cooling fans 39 and 40 for cooling the scroll compressing mechanism blocks 23 and 24 and V-pulleys 41 and 42. The cooling fans 39 and 40 and the V-pulleys 41 and 42 are fixedly mounted on shafts 43 and 44 of the compressing mechanism blocks 23 and 24, respectively. An air releasing pipe 45 having branch pipes 45*a* and 45*b* is connected between the air release valve 33 and the air discharging pipes 27 and 28.

Each of the oil-free scroll compressing mechanism blocks 23 and 24 has a construction as described in the description of the prior art.

An explanation will be given to the flow of air at the time of loading. The outside air is suctioned through the suction filter 20 and is passed through the throttle valve 21 into the collecting pipe 22. Then, the air is divided and passed into the first scroll compressing mechanism block 23 and the second scroll compressing mechanism block 24 through the suction pipes 25 and 26. The scroll compressing mechanism blocks act to increase the air pressure to a predetermined pressure (usually, 7 $Kgf/cm^2$ g). The air having increased pressure is conducted through the discharging pipe 27, the check valve 29 and the discharging pipe 28, the check valve 30 into the after cooler 31, which acts to cool the air to a temperature lower than the atmospheric temperature +15 degrees, and the cooled air is supplied through the discharging port 32 to the compressed air using side.

The first and second scroll compressing mechanism blocks 23 and 24 are driven by the dual-shaft motor 34 through the M-groove sheaves 35 and 36, the V-belts 37 and 38 and the V-pulleys 41 and 42, respectively. These scroll compressing mechanism blocks are forcibly cooled by cooling winds 47 and 48 blown off from a fan duct 46 to which cooling air is fed by means of the cooling fans 38 and 40.

Under no-loading condition (namely, when no compressed air or substantially no compressed air is needed), the throttle valve 21 is closed while the release valve 33 is opened, whereby the suction of the air through the suction filter 20 into the collecting pipe 22 is suppressed, while the compressed air held in the discharging pipes 27 and 28 between the respective scroll compressing mechanism blocks 23, 24 and the check valves 29, 30, respectively, is passed through the air releasing pipes 45*a*, 45*b* and 45 to the release valve 33 from which the air is discharged to the atmosphere. Thus, the increase in temperature of the discharged air owing to increase in the compression ratio under no-load condition is avoided and the power for driving the shaft is decreased.

The characteristic feature of the present invention resides in solving the aforementioned technical problem encountered in realizing a large capacity scroll compressor, as explained above, and in order to attain such object the present invention provides a scroll compressor which includes a plurality of oil-free scroll compressing mechanism blocks, each having a relatively small diameter, which are simultaneously driven by a motor or motors, thereby enabling to realize an oil-free scroll compressor which has an increased capacity, as a whole. The preferred embodiment which has been described with reference to FIG. 2 is directed to the construction in which two oil-free scroll compressing mechanism blocks are simultaneously driven by the single dual-shaft motor, whereby a capacity corresponding to double of that of the single oil-free scroll compressing block can be produced. Thus, an oil-free scroll compressor of medium capacity, namely 5–11 KW capacity, which has hitherto been difficult to produce from the technical viewpoint, can be easily manufactured.

Figure 3:
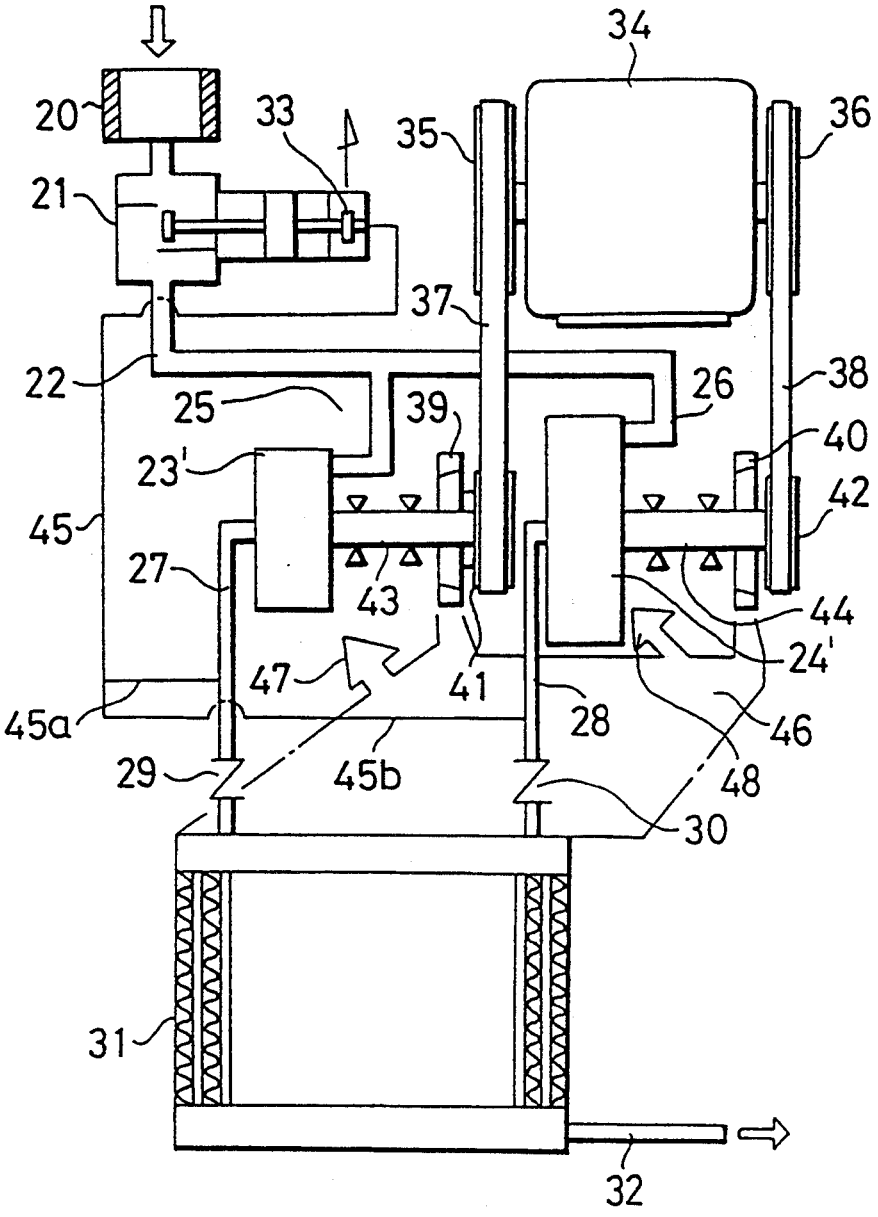
FIG. 3 illustrates another embodiment of the oil-free scroll compressor according to the present invention, like that in FIG. 2 except that the oil-free scroll compressing mechanism blocks have different diameters.

The respective oil-free scroll compressing mechanism blocks are not always required to be driven by a single motor, but they may be driven by separate motors. The blocks are not always required to have a same scroll diameter but they may have different scroll diameters, respectively, as shown in FIG. 3 at 23' and 24'. Although, in the embodiment as described above, the oil-free scroll compressing mechanism blocks 23 and 24 are connected in parallel, the plurality of oil-free scroll compressing mechanism blocks may be connected in multi-stage type (usually, two-stage). In the case of the multi-stage compressor, the overall capacity of the compressor is determined by that of the first stage; however, to produce the same final pressure, the pressure of the first stage can be lowered in the case of the multi-stage compressor as compared to the single stage compressor so that the gas pressure applied to the scroll end plate can be lowered and thus the diameter of the first stage and, consequently, its capacity, can be increased, as compared to the single-stage compressor, with the result that the entire capacity can be increased.

The present invention thus far described provides the following technical advantages:

Since a plurality of oil-free scroll compressing mechanism blocks are arranged, an oil-free scroll compressor having an increased capacity which it has been technically difficult to realize in the prior art, can be provided.

By the construction of the oil-free scroll compressor which is divided into a plurality of blocks, it is possible to provide an oil-free scroll compressor which has a lowered temperature of discharged air (lower than about 150° C.), a reduced thermal expansion of the scrolls in the scroll compressing mechanism block and a high reliability.

By the construction of the oil-free scroll compressor which is divided into a plurality of oil-free scroll compressing mechanism blocks, it is possible to provide an oil-free scroll compressor which has a reduced mechanical loss at a low rotating speed, a high efficiency and maintain a mechanical merit of the scroll compressor, that is, a low noise.

The oil-free scroll compressor according to the present invention requires a considerably small number of constituent elements as compared to that required in the screw type oil-free compressor and, therefore, it can be manufactured at a low cost. (It is possible to reduce the manufacturing cost by about 30% as compared to the screw type oil-free compressor.)

What is claimed is:

1. An oil-free scroll compressor comprising:

a throttle valve disposed downstream of a suction filter, said throttle valve being adapted to be opened during a loading of the compressor and closed at a time of no loading of the compressor; an air release valve arranged to operate in association with the throttle valve so as to close the throttle valve during the non-loading of the compressor; a plurality of oil-free scroll compressing mechanism blocks connected in parallel, each for compressing a gas; suction pipes branching from a single collecting pipe from the throttle to conduct suctioned air to the respective compressing mechanism blocks; air releasing pipes connected to the air release valves and discharging pipes for discharging air from the respective compressing mechanism blocks through check valves into a single after cooler and through a single discharge port; and a single motor for driving said plurality of oil-free scroll compressing mechanism blocks, wherein an entire capacity of the oil-free scroll compressor is increased.

2. An oil-free scroll compressor according to claim 1, wherein the plurality of oil-free scroll compressing mechanism blocks have a same diameter.

3. An oil-free scroll compressor according to claim 1, wherein the plurality of oil-free scroll compressing mechanism blocks have different diameters.

* * * * *